United States Patent [19]

Iwabuchi et al.

[11] Patent Number: 4,719,868

[45] Date of Patent: Jan. 19, 1988

[54] SEWING MACHINE

[75] Inventors: Haruo Iwabuchi; Yutaka Asaba, both of Tama, Japan

[73] Assignee: Tokyo Juki Industrial Co., Ltd., Chofu, Japan

[21] Appl. No.: 833,334

[22] Filed: Feb. 25, 1986

[30] Foreign Application Priority Data

Feb. 28, 1985 [JP] Japan ..... 60-39505
Feb. 28, 1985 [JP] Japan ..... 60-39506

[51] Int. Cl.[4] ..... D05B 3/04
[52] U.S. Cl. ..... 112/461
[58] Field of Search ..... 112/459, 461, 448, 449, 112/453, 455, 121.12, 315

[56] References Cited

U.S. PATENT DOCUMENTS 4,271,773 6/1981 Makabe et al. ..... 112/453
4,519,328 5/1985 Takenoya et al. ..... 112/121.12 X
4,559,887 12/1985 Sano ..... 112/459 X
4,563,966 1/1986 Sano ..... 112/455

FOREIGN PATENT DOCUMENTS 114882 8/1984 Japan .

*Primary Examiner*—Peter Nerbun
*Attorney, Agent, or Firm*—Tarolli, Sundheim & Covell

[57] ABSTRACT

The present invention relates to an improvement in the home point detection of a motor for a sewing machine wherein the motor is used to rotate a cam into a predetermined feed pitch formed on the cam, and change in the quantity of work piece feeding that corresponds to such feed pitch is transferred to a feed dog through a linkage means. Respective feed pitches are formed in each of the regions of the cam, whereas the detecting position of home point of the motor is set in a suitable position. Moreover, the rotating direction of the cam toward the detecting position of home point is reversed in accordance with each of the regions. Accordingly, the returning speed of the motor back to the detecting position of home point is made fast and only one home point detector is used.

11 Claims, 9 Drawing Figures

| Fig. 8 A | Fig. 8 B |
|---|---|

SEWING MACHINE

BACKGROUND OF THE INVENTION

1. Field of the Invention

The present invention relates to a sewing machine utilizing a stepping motor to convert the quantity of work piece feeding, and more particularly to an improvement of home point detection for the motor.

2. Description of the Prior art

In such prior art sewing machine, a work piece feeding cam 2 having a cam groove 1 formed along the entire periphery thereof is threadably secured to a feed stepping motor 3, as shown in FIG. 1, the cam groove 1 providing a feed pitch as a diameter from the center thereof. The contactor 6 of contactor arm 5 is slidably engaged with the cam groove 1, and the stepping motor 3 is actuated to rotate the work piece feeding cam 2 in one direction so that the diametral displacement of cam groove 1 is transferred to a feed regulator 7 as data representing a change in the quantity of work piece feeding. The feed mechanism 8 of known configuration is used to set the feed pitch of feed dog 9.

Advantages of such feed mechanism are the availability of inexpensive stepping motor and the possibility of setting a precise quantity of work piece feeding.

For such sewing machine incorporating the stepping motor, however, a so-called home point correcting procedure is required to apply in order to actuate the stepping motor return back to its home point during sewing operation, and thereby checking for proper rotating position for avoidance of step out of the stepping motor. The home point of the stepping motor means zero point of the motor. This correcting procedure has been made hereinbefore simultaneously when the sewing operation is stopped, the power switch is turned ON or during conversion of quantity of work piece feeding in starting the sewing machine operation, in order to check for proper position for avoidance of step out of motor operation.

For this reason, the home point correcting procedure of the stepping motor must be completed in a brief period. To this end, a traditional device operable to rotate the work piece feeding cam only in one direction comprises a plurality of detecting positions of home point formed over the work piece feeding cam 2 and a plural number of home point detectors including light emitting and receiving elements, the number being selected to match the number of detecting positions of home point. Thus, a shield plate 13 formed over the work piece feeding cam 2 can shield the home point detectors 12 which correspond to respective detecting positions of home point. This permits the stepping motor to reduce its rotating angle in correcting its home point, whereby ensuring a speedy execution of home point correcting procedure.

However, this arrangement presents a drawback in that the machine structure itself and its control sequence tend to be complicated for the need of providing plural number of home point detectors, whereby causing the machine to an added manufacturing cost. Though an alternative arrangement has been suggested wherein only a single home point detector is provided, this approach is impractical for an actual application since the response speed is quite slow in responding to a home point correcting signal for the stepping motor.

The present invention has been made to improve several problems in a prior art, and its object is to provide a sewing machine which can carry out the home point correction of stepping motor in an accelerated speed through single home point detector, without complicating a control sequence and increasing a manufacturing cost.

SUMMARY OF THE INVENTION

The sewing machine of present invention is characterized in that feed pitches (that is, stitch pitches) for straight and zigzag pattern or super pattern are respectively formed according to regions over the periphery of cam groove of a work piece feeding cam, and the rotating direction of work piece feeding cam toward a position where the home point is detected is reversed according to respective patterns, while at the same time permitting single home point detector commonly usable in detecting the home point for respective patterns. The super pattern means that feeding direction is reversed every swing operation.

Another characteristic of the present invention lies in that feed pitches (that is, stitch pitches) for straight and zigzag pattern or super pattern are respectively formed according to regions over the periphery of a cam groove in a work piece feeding cam, a detecting position of home point common to respective patterns is selected in one of the regions, and the direction of rotation of the work piece feeding cam toward the position where the home point is detected is reversed according to respective patterns, while at the same time permitting a single home point detector to be usable in common for respective patterns in detecting their respective home points.

Still another characteristic of the present invention lies in that feed pitches (that is, stitch pitches) for straight and zigzag pattern or super pattern are respectively formed according to regions over the periphery of cam groove of work piece feeding cam, detecting positions of home point to respective patterns are selected respectively in the boundary of regions, and the rotating direction of work piece feeding cam toward the position where the home point is detected is reversed according to respective patterns, while at the same time permitting a single home point detector to be usable in common for respective patterns in detecting their respective home points.

BRIEF DESCRIPTION OF THE DRAWINGS

By way of example, one embodiment of the present invention described hereinbelow, by making reference to several accompanying drawings wherein.

DETAILED DESCRIPTION OF THE PREFERRED EMBODIMENTS

Figure 2:
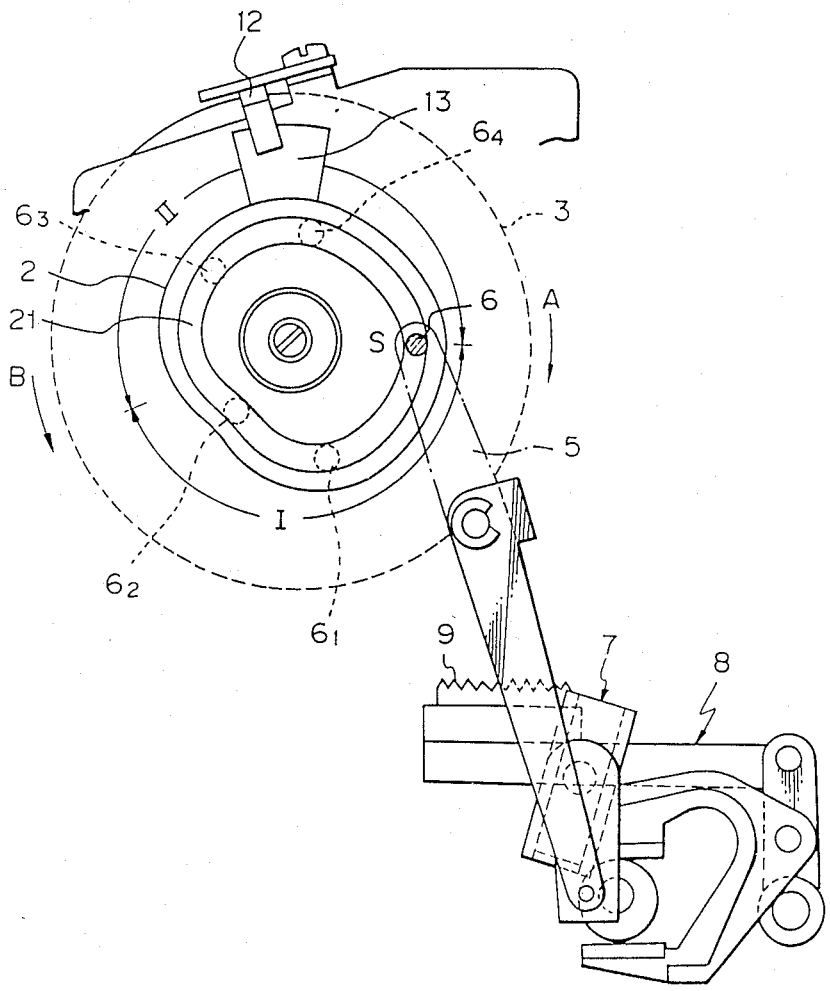
FIG. 2 is a view of essential components in the first embodiment of the invention.

Referring to FIG. 2, characteristic components in first embodiment of the present invention are shown. In this FIG. 2, a contactor arm 5 is partially shown with a dot and dashed line.

Figure 1:
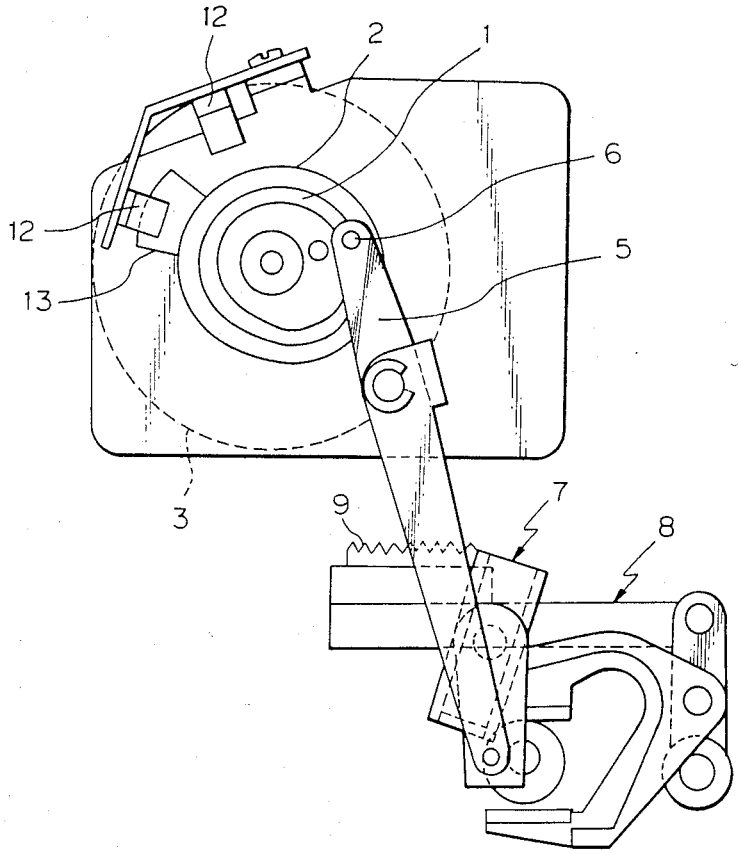
Fig. 1 (PRIOR ART)
FIG. 1 is a diagrammatic view of prior art device.

Comparing the device of FIG. 2 with that of FIG. 1, it is known that the characteristic of the present invention lies in that the peripheral region of cam groove 21 of work piece feeding cam 2 along which feed pitches (that is, stitch pitches) are formed is divided into two parts, i.e., a region I along which a feed pitch for super pattern is formed and a region II along which a feed pitch for straight pattern (including zigzag pattern) is formed, a single home point detector of the motor (hereinafter merely called as "home point position") S is set in one of boundaries between the regions I and II, and a home point detector 12 is shielded by a shield plate 13 when the contactor 6 is located in the home point position S.

In this present embodiment, the single home point detector 12 comprises a light emitting element and a light receiving element facing each other in an opposing fashion with an extremely small clearance formed therebetween, and function to provide a sensor output (dark output) upon the shield plate 13 being rotated to enter into the clearance space. The feed pitch of cam groove 21 is formed as (+4) at the starting point position S.

This embodiment is identical in other respects to that of FIG. 1, and therefore components common to both FIG. 1 and FIG. 2 are shown by the same numerals.

Figure 3:
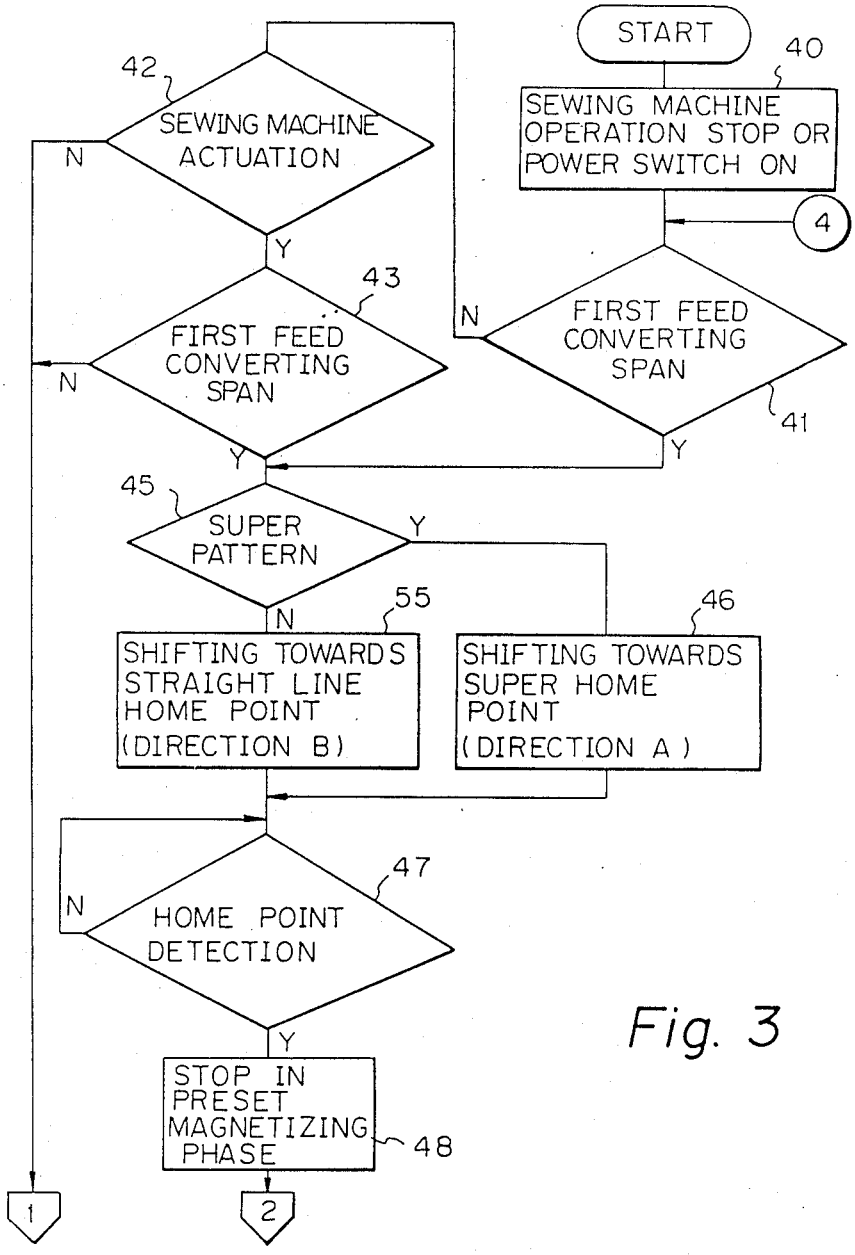
FIGS. 3 and 4 are flow charts of the first embodiment of the invention.
Figure 4:
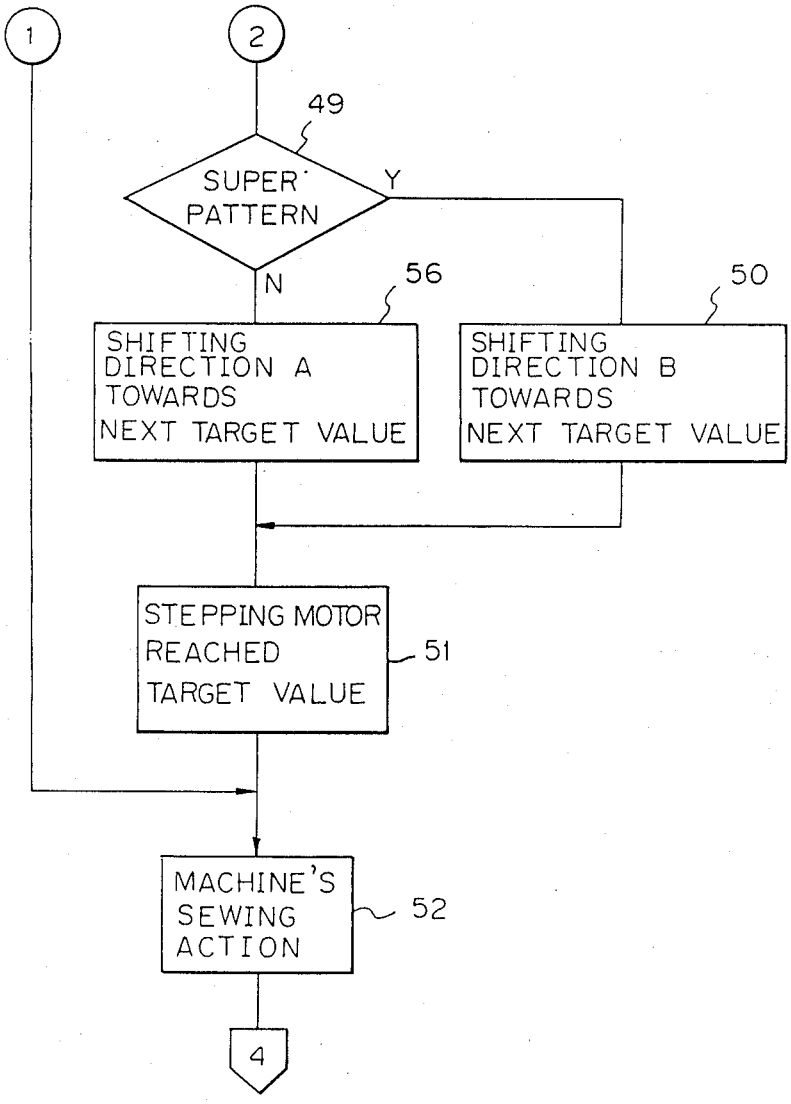

FIGS. 3 and 4 are flow charts, showing the home point correcting sequence of the first embodiment in accordance with the present invention.

Figure 5:
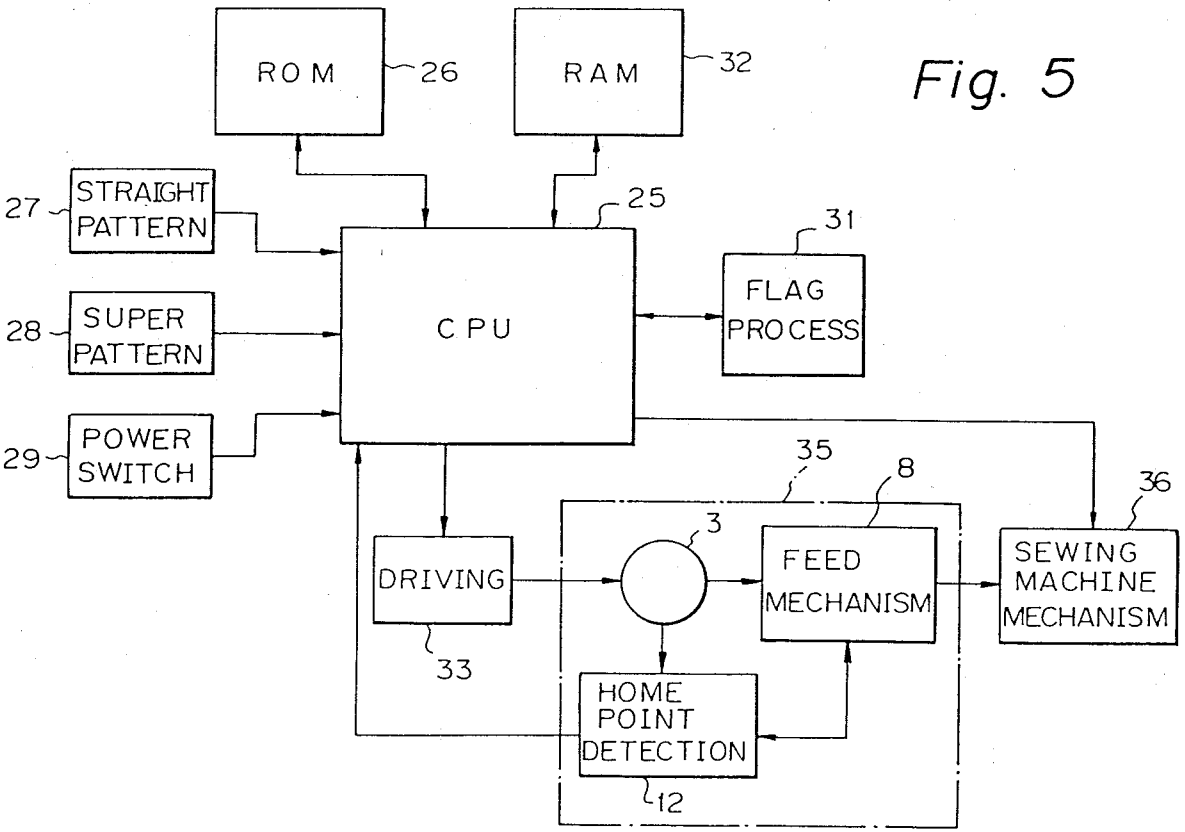
FIG. 5 is a block diagram of essential components in the first and second embodiments of the invention.

FIG. 5 are block diagrams of essential components of first and second embodiments in accordance with the present invention. Connected with a control section (CPU) 25 is a memory circuit ROM 26 which is exclusively designed for read-out function and has stored program sequences on the basis of flow charts shown in FIGS. 3 and 4 (or FIGS. 7 and 8) and sewing patterns for super pattern and straight pattern and the like. Also connected with the control section 25 is a straight pattern switch 27 selecting and indicating the feed pitch of straight pattern (including zigzag pattern), a super pattern switch 28 selecting and indicating a super pattern and a power switch 29. Likewise connected with the control section 25 is a flag process circuit 31 setting a flag that indicates the first feed converting span and a memory circuit RAM 32 capable of writing and reading data. A driving circuit 33 for the stepping motor 3 is also connected with the control section 25. A feed converting mechanism 35 built in accordance with the present invention is connected with the stepping motor 3. A reference numeral 36 designates a known sewing machine mechanism.

A characteristic operation of first embodiment thus formed in accordance with the present invention will be described hereinbelow.

If the sewing machine operation is stopped or if the power switch 29 is turned ON while the machine is raised upwardly, the control section 25 discriminates that a flag process circuit 31 has not set a flag indicative of the first converting span therein (as shown in FIG. 3 blocks, 40, 41, called merely as "block" hereinafter). Then, the control section 25 initiates the actuation of sewing machine by the sewing mechanism 36 (block 42). If the sewing machine is actuated and the flag process circuit 31 has set the flag therein, the control section 25 discriminates it as the first feed converting span (block 43) and functions uniquely as described below.

Also, if the sewing machine operation is stopped or if the power switch 29 is turned ON while the machine is lowered downwardly, the control section 25 discriminates it as the first converting span since a flag is set in the flag process circuit 31, and the control section 25 functions uniquely as described below (blocks 40, 41).

The term "first feed converting span" means the first feed span immediately after the stop of sewing machine operation.

If a super pattern is selected and indicated as a pattern to be sewn by a super pattern switch 28, the control section 25 discriminates it as a super pattern sewing mode (block 45) and carries out a home point correcting procedure for super pattern. The stepping motor 3 is thereby caused to rotate the work piece feeding cam 2 in the direction A until it returns back to the home point position S.

The contactor 6 which is located at, for example, a position $6_1$ within the region I as shown in FIG. 2 can be instantly returned back to the home point position S. At this moment, the home point detector 12 is shielded by the shield plate 13 to provide the sensor output for detecting the home point, whereby causing the stepping motor 3 to stop in a home point setting magnetizing phase (blocks 46, 47, 48). This home point detecting operation is repeated until the home point is reached. Upon the control section 25 detecting the home point, the stepping motor 3 is caused to rotate in the direction B for rotating the work piece feeding cam 2 into a next feed pitch according to the sewing pattern of super pattern which has been stored in the ROM 26 (blocks 49, 50).

In this way, the contactor 6 is placed in a position of, for example, feed pitch (+1) as shown at $6_2$ in FIG. 2, and the feed mechanism 8 sets the quantity of work piece feeding of feed dog 9 in accordance with this displacement (blocks 50, 51). A sewing operation is effected in a known manner at this feed pitch (block 52).

If a straight sewing pattern is selected and indicated by means of straight pattern switch 27 in the block 45, the control section 25 discriminates it as straight pattern (block 55) and effectuates the home point correcting mode with the straight pattern and causes the stepping motor 3 to rotate the work piece feeding cam 2 in the direction B until it returns back to the home point position S. In this way, the contactor 6 which is located at, for example, at a position $6_3$ within the region II as shown in FIG. 2, can be instantly returned back to the home point position S. At this moment, the home point detector 12 is shielded by the shield plate 13 to provide the sensor output for detecting the home point, and whereby causing the stepping motor 3 to stop in the home point setting magnetizing phase (blocks 55, 47, 48). This home point detecting operation is repeated until the home point is detected.

Upon the control section 25 detecting the home point, the stepping motor 3 is caused to rotate in the direction A to rotate the work piece feeding cam 2 to a straight pattern sewing pitch as preset through the straight pattern switch 27 (block 56).

In this way, the contactor 6 can be placed in a feed pitch (+2) shown, for example, at $6_4$ in FIG. 2, and the feed mechanism 8 set the quantity of work piece feeding of feed dog 9 in accordance with this displacement (blocks 56, 51). A sewing operation is performed in a known fashion at this feed pitch (block 52)

As described hereinbefore, the feed pitch of cam groove 21 is formed in respective regions corresponding to different patterns and the home point position of patterns is at the boundary position of the regions so that the rotating direction toward the home point can be reversed in accordance with each of the patterns. Thus, a distance to the home point is so reduced that even a single home point detector is sufficient to detect the zero point successfully.

Figure 6:
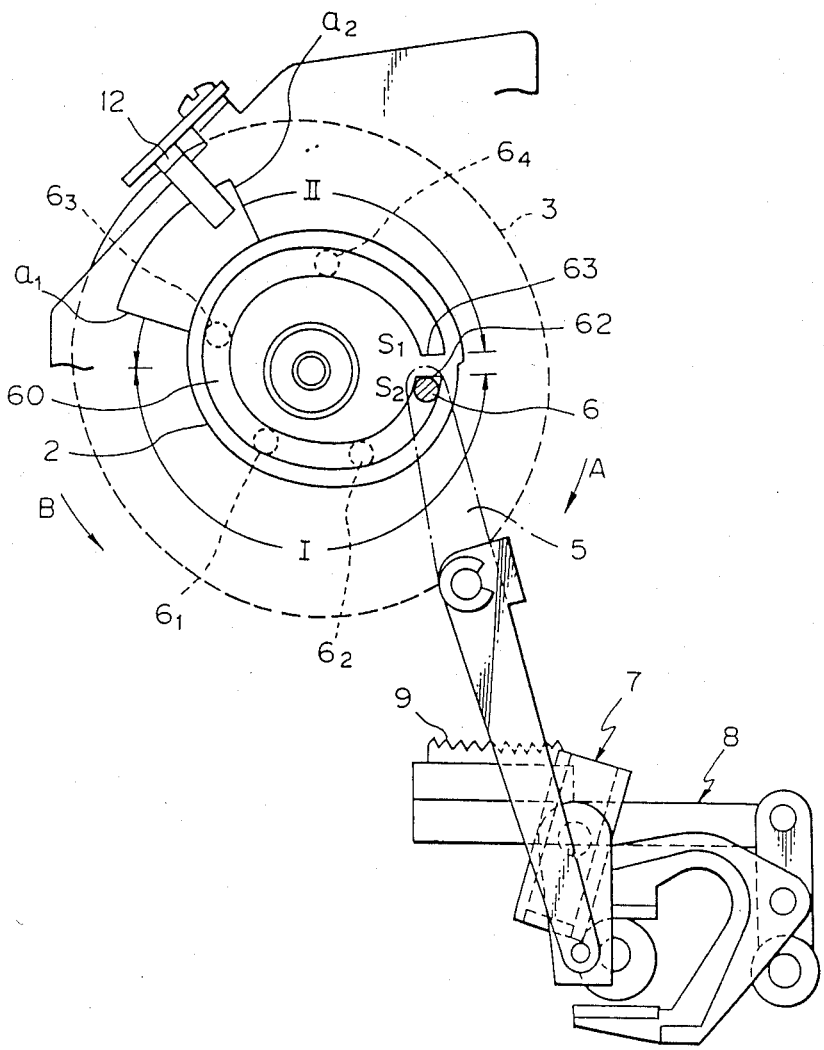
FIG. 6 is a view of essential components in second embodiment of the invention.

FIG. 6 shows the general arrangement of characteristic components in the second embodiment of the invention wherein identical numerals are used to indicate components all common to FIG. 6 and FIGS. 1 and 2. In this FIG. 6, the contactor arm 5 is partially shown with a dot and dashed line.

Comparing a prior device shown in FIG. 1, it is known that the characteristic aspect of present invention lies in that the peripheral region of cam groove 60 of the work piece feeding cam 2 along which feed pitches (that is, stitch pitches) are formed is divided into two parts i.e., a region I along which a feed pitch for super pattern is formed and a region II along which a feed pitch for straight pattern (including zigzag pattern) is formed, one boundary portion between regions I and II is formed as a discontinuous section and opposite ends 62, 63 of cam groove 60 are formed as stopper in respective regions I and II of contactor 6. Moreover, while a detecting position of home point of the motor for the straight pattern (called as "home point position for straight pattern" hereinafter) $S_1$ is set at the end 63 of cam groove 60, a detecting position of home point of the motor for the super pattern (called as "home point position for super pattern") $S_2$ is preset at the end 62 of cam groove 60. Furthermore, another characteristic of the invention lies in that a single home point detector 12 is placed in position such that when the contactor 6 is located at the home point position for super pattern $S_2$, the detector 12 is shielded by the rightward end $a_2$ of shield plate 13, whereas the detector 12 is shielded by the leftward end $a_1$ of shield plate 13 when the contactor 6 is located in the home point position for straight pattern $S_1$.

In this embodiment, the home point detector 12 is formed such that the detector 12 may provide a sensor output (dark output) upon the shield plate 13 rotated to enter into an extremely small clearance formed between a light emitting element and a light receiving element provided in an opposing fashion. The feed pitch of cam groove 60 is formed as (+4) for the home point position for straight pattern $S_1$, whereas the feed pitch of cam groove 60 is formed as (+2.5) for the home point position for super pattern $S_2$.

Figure 7:
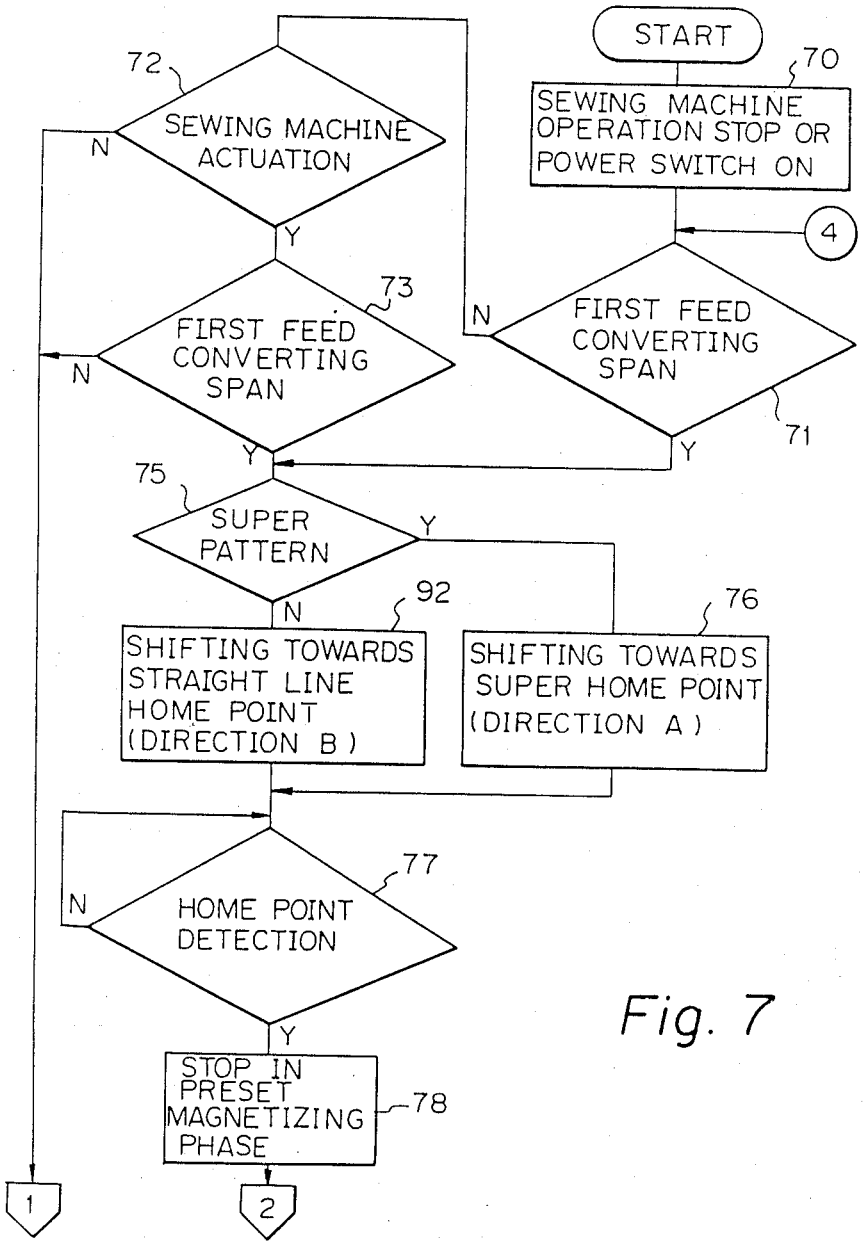
FIGS. 7, 8*a*, and 8*b* are flow charts of second embodiment of the invention.
Figures 8, 8A:
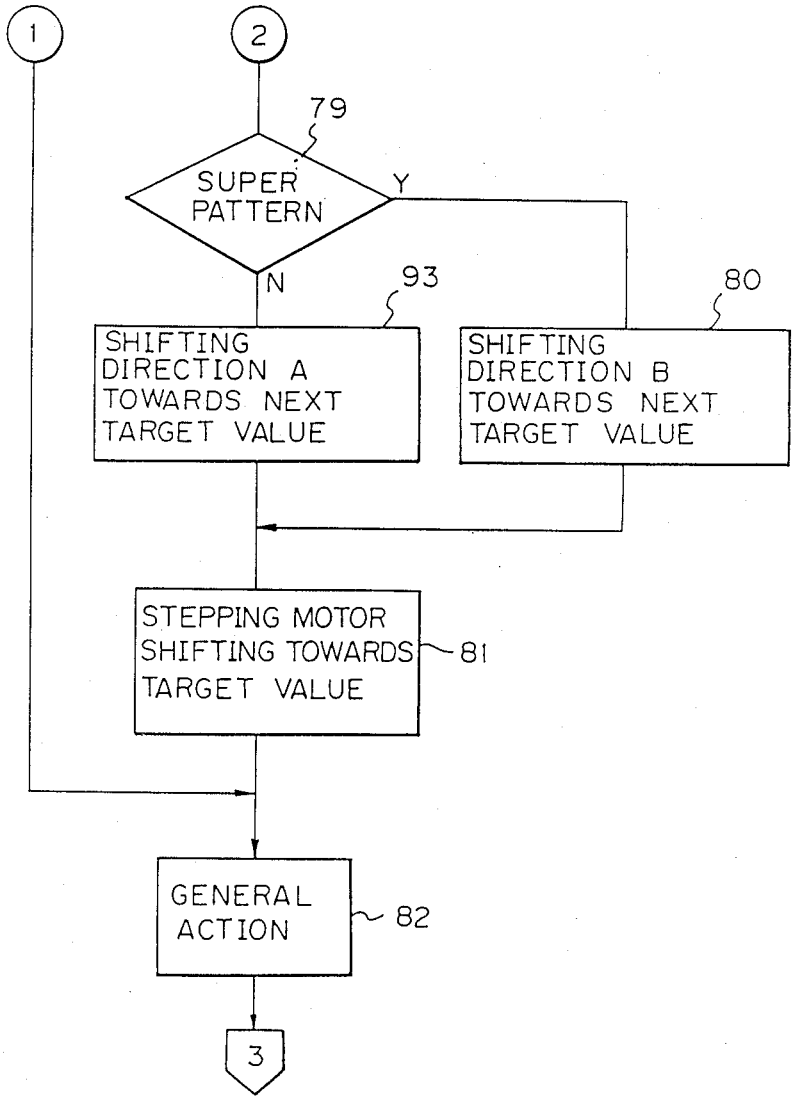
Figure 8B:
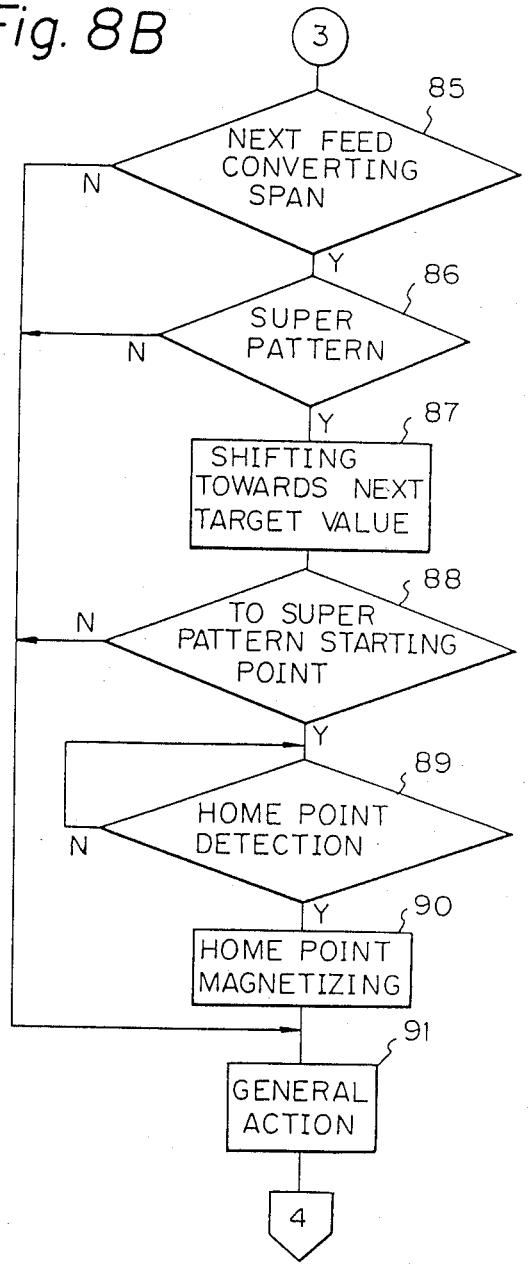

FIGS. 7 and 8 are flow charts, showing the home point correcting sequences of the second embodiment of the invention.

Second embodiment of the invention thus formed will be described hereinbelow as to its characteristic operation.

If the sewing machine operation is stopped or if the power switch 29 is turned ON while the machine is raised upwardly, the control section 25 discriminates that a flag process circuit 31 has not set a flag indicative of the first converting span therein (blocks, 70, 71 of FIG. 7—called merely as "block" hereinafter). Then, the control section 25 discriminates the actuation of sewing machine by the sewing mechanism 36 (block 72). If the sewing machine is actuated and the flag process circuit 31 has set the flag therein, the control section 25 discriminates it as the first feed converting span (block 73) and functions uniquely as described below.

Also, if the sewing machine operation is stopped or if the power switch 29 is turned ON while the machine is lowered downwardly, the control section 25 discriminates it as the first converting span since a flag is set in the flag process circuit 31 in block 71, and then functions uniquely as described below (blocks 70, 71).

If a super pattern is selected and indicated as a pattern to be sewn by a super pattern switch 28, the control section 25 discriminates it as a super pattern sewing mode (block 75) and carries out a home point correcting procedure for super pattern. The stepping motor 3 is thereby caused to rotate the work piece feeding cam 2 in the direction A until it returns back to the home point position $S_2$.

The contactor 6 which is located at, for example, a position $6_1$ within the region I as shown in FIG. 6 can be instantly returned back to the home point position $S_2$. At this moment, the home point detector 12 is shielded by the rightward end $a_2$ of shield plate 13 to provide the sensor output for detecting the home point whereby causing the stepping motor 3 to stop in a home point setting magnetizing phase (blocks 76, 77, 78). This home point detecting operation is repeated until the home point is detected. The end 62 of cam groove 60 also acts as a stopper against rotation in the direction A.

Upon the zero point detected, the control section 25 causes the stepping motor 3 to rotate in the direction B, thereby rotating the work piece feeding cam 2 into a next feed pitch according to the sewing pattern of super pattern stored in the ROM 26 (blocks 79, 80). This permits the contactor 6 to locate at a position such as, for example, shown at $6_2$ in FIG. 6 with the feed pitch of (+1). The feed mechanism 8 sets the quantity of work piece feeding of feed dog 9 in accordance with this displacement (blocks 80, 81). A sewing operation is carried out with this feed pitch in a known sequence (block 82).

Upon the control section 25 discriminated next feed converting span in response to a signal from the sewing machine mechanism 36 (block 85), the work piece feeding cam 2 is caused to rotate into such next feed pitch position by means of stepping motor 3 in a similar manner, and thereby setting the quantity of work piece feeding of feed dog 9 as above described (blocks 86, 87).

At this moment, if a feed pitch to be set is similar to that for home point position for super pattern $S_2$ i.e., feed pitch (+2.5), the control section 25 discriminates it (block 88) and actuates the stepping motor to detect the home point in a similar sequence as that shown in blocks 76, 77 and 78 (that is, the work piece feeding cam is rotated in the direction A) (blocks 87, 88, 89 90). Once the feed pitch has been set, a sewing operation is carried out in a known sequence (block 91). Subsequent operations are the same as those described above.

If the straight pattern is selected and indicated as a sewing pattern in block 75 by means of straight pattern switch 27, the control section 25 discriminates it as straight pattern (block 75) and effectuates the home point correcting mode sequence for the straight pattern. That is, the stepping motor 3 is actuated to rotat the work piece feeding cam 2 in the direction B until the cam 2 returns back to the home point position for straight pattern $S_1$. This permits the contactor 6 to instantly return from a position in the region II such as, for example, shown at $6_3$ in FIG. 6 back to the home point position for straight pattern $S_1$. At this moment, the home point detector 12 is shielded by the leftward end $a_1$ of shield plate 13 to provide a sensor output for detecting the home point, and then the stepping motor 3 stops in a home point setting magnetizing phase (blocks 92, 77, 78). This home point detecting operation is repeated until the home point is successfully detected. The end 63 of cam groove 60 acts as a stopper preventing rotation in the direction B.

Upon the home point detected, the control section 25 causes the stepping motor 3 to rotate in the direction A, thereby rotating the work piece feeding cam 2 into a sewing pitch for straight pattern which has been set by the straight pattern switch 27 (block 93). This permits the contactor 6 to locate at such feed pitch (+2) position as, for example, shown at $6_4$ in FIG. 6. The feed mechanism 8 sets the quantity of work piece feeding of feed dog 9 in accordance with this displacement (blocks 93, 81). A sewing operation is carried out with this feed pitch in a known sequence (block 82). Since the feed pitch is held constant for the straight pattern, the feed pitch is not converted in next feed converting span despite its discrimination through the control section 25 (block 85), the sewing operation is continued with such constant feed pitch (block 91).

As described hereinbefore, the feed pitch of cam groove 60 is formed in respective regions divided by patterns, the home point positions for respective patterns are formed in the boundary of regions and the rotation direction toward respective home point positions is reversed in accordance with each of patterns. As a result, the time needed to reach the home point is extremely reduced to allow a single home point detector provide sufficient home point correcting operation.

In the first and second embodiments described above, the home point detector comprises a light emitting element, a light receiving element and a shield plate. Alternatively, the cam may be provided with a shifting contact and the home point detector may be provided with a stationary contact.

Besides, respective regions for patterns are preferably formed at substantially half around the cam groove. A feed pitch for reverse feeding is also formed in the region II for straight pattern.

As described above, the present invention is constituted such that respective feed pitches for straight pattern and super pattern are formed in regions formed by dividing the periphery of cam groove of work piece feeding cam, one or more detecting positions of home point of the motor which are commonly or respectively used for the patterns are formed on the work piece feeding cam, the rotating direction of work piece feeding cam toward the detecting position of home point is reversed in accordance with respective patterns, and the home point detector is used in common.

In consequence, it becomes possible to greatly reduce a distance to the detecting position of home point, and thereby greatly shortening time needed to reach the detecting position of home point. Thus, even a single home point detector is commonly used for respective patterns, a response speed of stepping motor is sufficient for detecting home point. Furthermore, the present invention provides another advantage of preventing complication of control program sequence for the home point detection and reducing the manufacturing cost of device.

What is claimed is:

1. A sewing machine, said machine comprising:

a cam setting a feed pitch formed thereon;

a linkage means engaging the cam and linked with a feed dog to vary the quantity of work piece feeding in accordance with a feed pitch; and a motor actuating the cam to rotate into a feed pitch position;

wherein said machine further comprises:

said cam having a plurality of regions and said feed pitch formed in each of said regions and at least one detecting position of home point of said motor set in a predetermined position;

means for discriminating and indicating a rotating direction of said cam toward the detecting position of said home point according to respective regions; and a single home point detector to be used in detecting the home point in said detecting position.

2. The sewing machine as set forth in claim 1, wherein a feed pitch for a first pattern is formed in one of said regions and a feed pitch for a second pattern is formed in another region.

3. The sewing machine as set forth in any of claims 1 and 2, wherein a feed pitch for reverse feeding is also formed in the region where the feed pitch for the second pattern is formed.

4. The sewing machine as set forth in any of claims 1 to 3, wherein said means for discriminating and indicating of rotating direction of said cam according to respective regions is formed by a control section adapted for use by a programmed control.

5. The sewing machine as set forth in any of claims 1 to 4, wherein said home point detector comprises a light emitting element and a light receiving element secured in place in an opposing relation to each other, and a shield plate integrally formed with said cam to shield an illuminated light from said light emitting element at said detecting position of the home point.

6. The sewing machine as set forth in any of claims 1 to 5, wherein said detecting position of the home point is set in the boundary of said regions as a position common to two regions.

7. The sewing machine as set forth in any of claims 1 to 5, wherein said detecting position of the home point is preset in each of said regions.

8. A sewing machine operable to feed different quantities of a workpiece during the sewing of different patterns on the workpiece, said sewing machine comprising a rotatable workpiece feed cam having a configuration corresponding to different workpiece feed pitches, said cam having a first pattern region along which workpiece feed pitch positions for a first pattern are formed and a second pattern region along which workpiece feed pitch positions for a second pattern are formed, a reversible motor connected to said cam and operable in one direction to rotate said cam in a first direction and operable in another direction to rotate said cam in a second direction opposite to the first direction, said cam having at least one home position in which said cam is in a predetermined orientation, workpiece feed means for engaging and feeding the workpiece during sewing of the workpiece, linkage means engageable with any one of the workpiece feed pitch positions on said cam and connected with said workpiece feed means for effecting operation of said workpiece feed means to feed a quantity of the workpiece corresponding to a workpiece feed pitch position on said cam engaged by said linkage means, and control means for effecting operation of said motor to rotate said cam in the first direction to a home position when said linkage means is in engagement with a feed pitch position in the first pattern region on said cam, for detecting when said cam has been rotated in the first direction to a home position, and for effecting operation of said motor to rotate said cam in the second direction from a home position to a position in which said linkage means is in engagement with a feed pitch position in the first pattern region on said cam during the sewing of the first pattern, said control means including means for effecting operation of said motor to rotate said cam in the second direction to a home position when said linkage means is in engagement with a feed pitch position in the second pattern region on said cam, for detecting when said cam has been rotated in the second direction to a home position, and for effecting operation of said motor to rotate said cam in the first direction from a home position to a position in which said linkage means is in engagement with a feed pitch position in the second pattern region on said cam during the sewing of the second pattern.

9. A sewing machine as set forth in claim 8 wherein said control means includes a single detector means for detecting when said cam has been rotated in the first direction to a home position and for detecting when said cam has been rotated in the second direction to a home position.

10. A sewing machine as set forth in claim 8 wherein said cam has only one home position, said control means includes a single detector means for detecting when said cam has been rotated in the first direction to said one home position and for detecting when said cam has been rotated in the second direction to said one home position.

11. A sewing machine as set forth in claim 8 wherein said cam has first and second home positions, said control means for detecting when said cam has been rotated in the first direction to said first home position and for detecting when said cam has been rotated in the second direction to said second home position.

* * * * *